US005570804A

United States Patent [19]

Chang et al.

[11] Patent Number: 5,570,804

[45] Date of Patent: Nov. 5, 1996

[54] RADIATOR COVER

[76] Inventors: Chang-Yao Chang, No. 424, Sec. 2, Ming Sheng Road, Pu, Hsin Hsiang, Chang Hua Hsien; Chin-Chang Lin, No. 3, Nan Jen Road, Tou Liu City, Yun Lin Hsien, both of Taiwan

[21] Appl. No.: 551,289

[22] Filed: Oct. 31, 1995

[51] Int. Cl.[6] ..... B65D 45/00

[52] U.S. Cl. ..... 220/316; 220/DIG. 32

[58] Field of Search ..... 220/316, 304, 220/DIG. 32; 215/330

[56] References Cited

U.S. PATENT DOCUMENTS

| | | | |
|---|---|---|---|
| 1,659,202 | 2/1928 | Jewell | 220/316 |
| 1,858,013 | 5/1932 | Heins | 220/316 |
| 4,700,866 | 10/1987 | Taylor | 220/316 |
| 5,036,996 | 8/1991 | Epstein | 220/316 |

*Primary Examiner*—Stephen K. Cronin
*Attorney, Agent, or Firm*—Beveridge, DeGrandi, Weilacher & Young, L.L.P.

[57] ABSTRACT

A radiator cover has an inner cover, a middle cover and an outer cover. The inner cover has a circular plate with a threaded post, a toothed disk with teeth on the top surface, two gaskets, a serpentine plug, a bolt and a circular washer. The middle cover has a bottom inward flange, two inserted holes on the top surface, a square post, a spring passed by the square post, and a toothed plate with a square hole inserted by the square post. The toothed plate has serrations at the bottom surface of the toothed plate, a cylinder on the top of the toothed plate, and a square hole at the center of the cylinder. The cylinder inserts in the spring. The serrations engage with the teeth. The outer cover has a circular wall and two pins extending downward from the top portion of the outer cover. The pins insert tightly into the corresponding inserted holes, respectively.

1 Claim, 5 Drawing Sheets

RADIATOR COVER

BACKGROUND OF THE INVENTION

The invention relates to a radiator cover. More particularly, the invention relates to a radiator cover which can be opened safely while the radiator is under high pressure and high temperature conditions.

Most conventional radiator covers cannot be opened safely while the radiator is under high pressure and high temperature conditions. The hot water will spout out of the radiator while the pressure and temperature of the radiator are very high. The pressure and temperature of the radiator cannot be effectively reduced even if the user uses a wet cloth to open the radiator cover.

SUMMARY OF THE INVENTION

An object of the invention is to provide a radiator cover which has three covers to protect the user while the radiator cover is opened at high pressure and high temperature.

Another object of the invention is to provide a radiator cover which has an outer cover to enclose a middle cover and an inner cover therein.

Accordingly, a radiator cover has an inner cover, a middle cover and an outer cover. The inner cover has a circular plate with an inner threaded post extending downward, a toothed disk, a first round gasket, a serpentine plug, a second round gasket, a bolt and a circular washer. The toothed disk has an annular groove surrounding the outer periphery of the toothed disk, a plurality of teeth surrounding the upper rim of the toothed disk, a circular recess defined by the teeth on the top of the toothed disk, and a center hole on the top of the toothed disk. The circular plate is disposed on the circular recess. The inner threaded post passes through the first round gasket, the serpentine plug and the second round gasket. Then the bolt screws the threads in the inner threaded post tightly. Thus the serpentine plug is beneath the toothed disk, and the first and second gaskets seal the upper and lower openings of the serpentine plug, respectively. The circular washer is disposed on the annular groove tightly. The hollow cylindrical middle cover has a bottom inward flange, two inserted holes formed on the top surface of the middle cover, a square post extending downward from the top portion of the middle cover, a compressed spring passed by the square post, and a toothed plate with a square hole inserted by the square post. The toothed plate has a plurality of serrations at the bottom surface of the toothed plate, a cylinder on the top of the toothed plate, and a square hole formed at the center of the cylinder. The cylinder inserts in the lower portion of the compressed spring. The serrations engage with the teeth. The hollow cylindrical outer cover has a circular wall and two pins extending downward from the top portion of the outer cover. The pins insert tightly into the corresponding inserted holes, respectively.

DETAILED DESCRIPTION OF THE INVENTION

Figure 1:
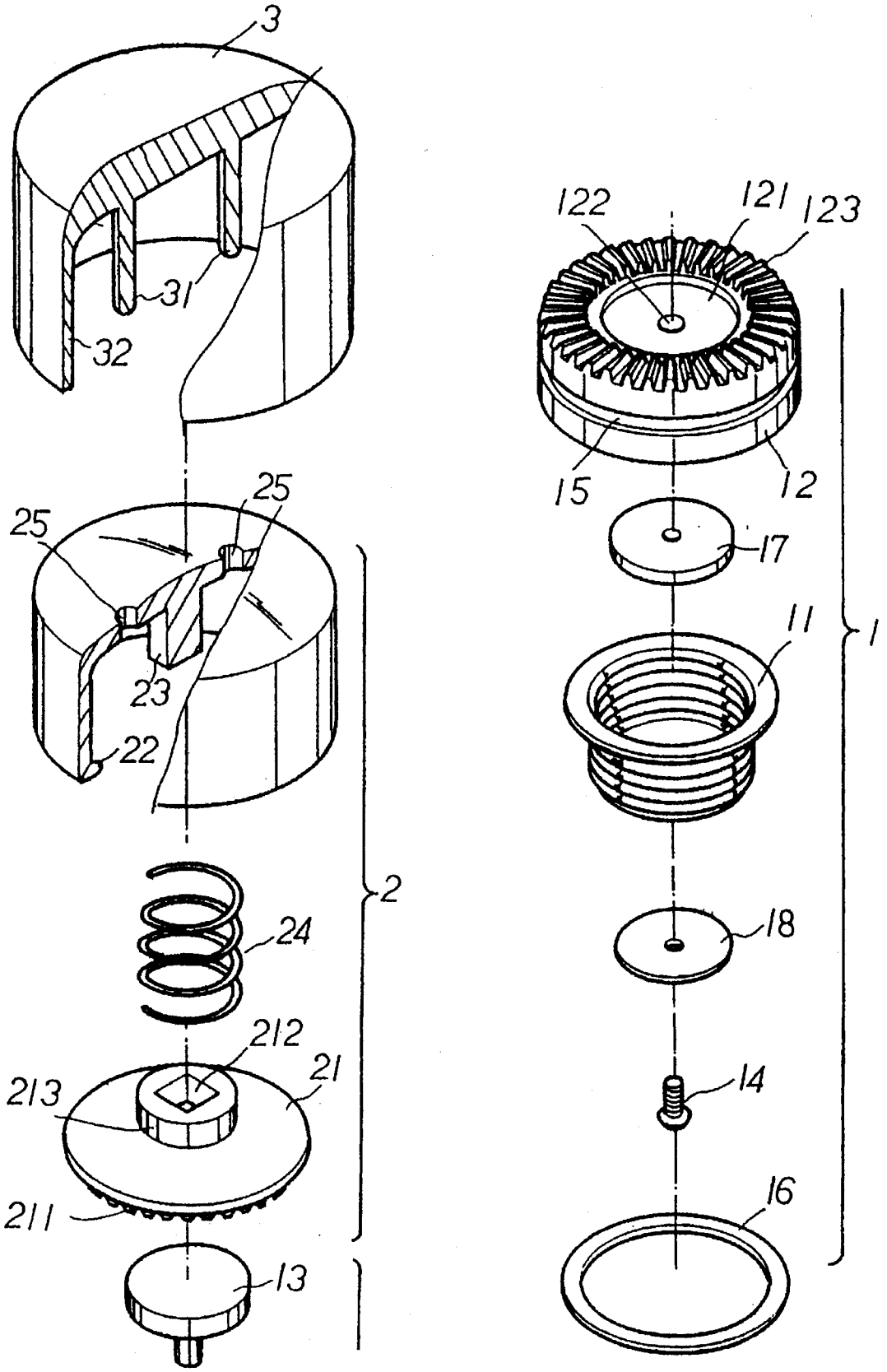
FIG. 1 is a perspective exploded view of a radiator cover of a preferred embodiment in accordance with the invention.
Figure 2:
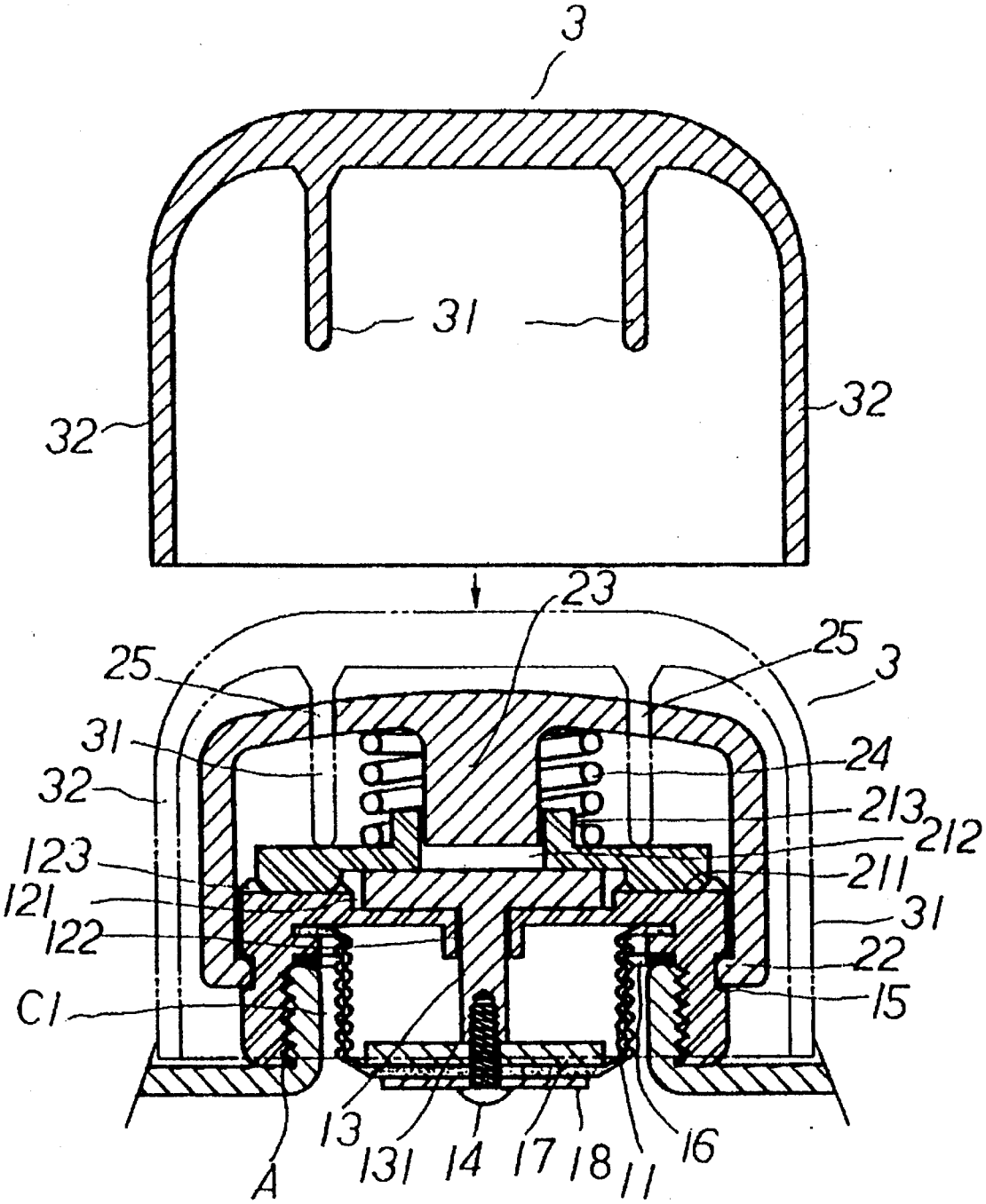
FIG. 2 is a cross-sectional view of a middle cover and an inner cover with threads on the inner periphery of a toothed disk and a schematic view of an outer cover covering the middle cover and the inner cover.
Figure 3:
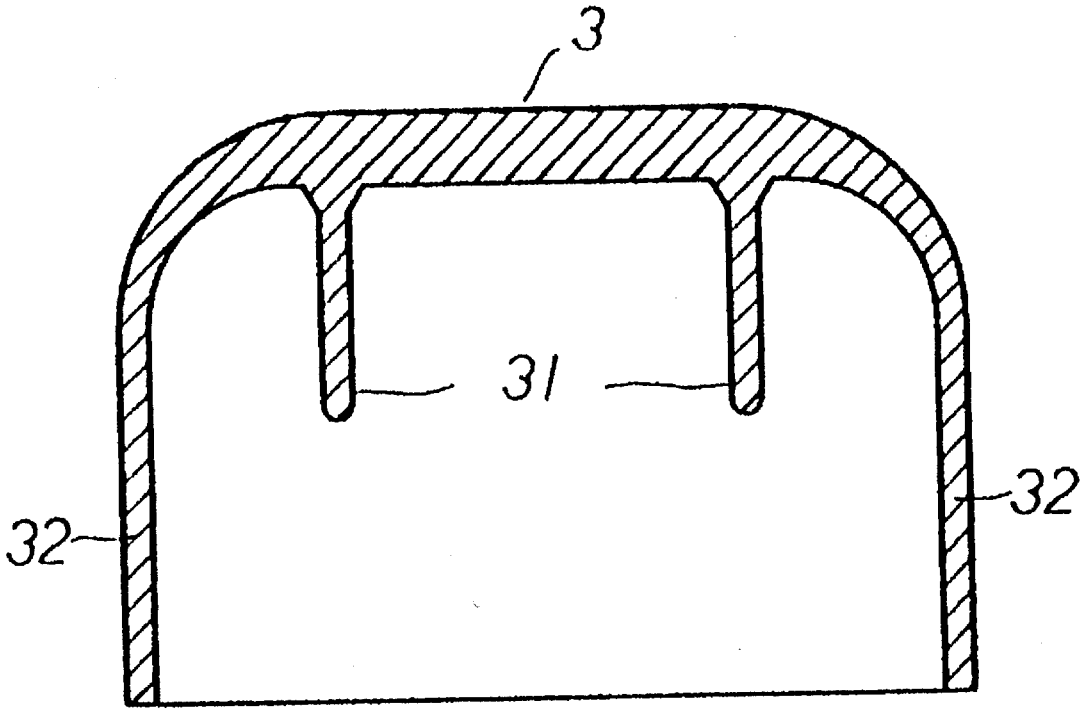
FIG. 3 is a cross-sectional view of a radiator cover with rotated inner flanges on the inner periphery of a toothed disk while an outer cover is separated.
Figure 3:
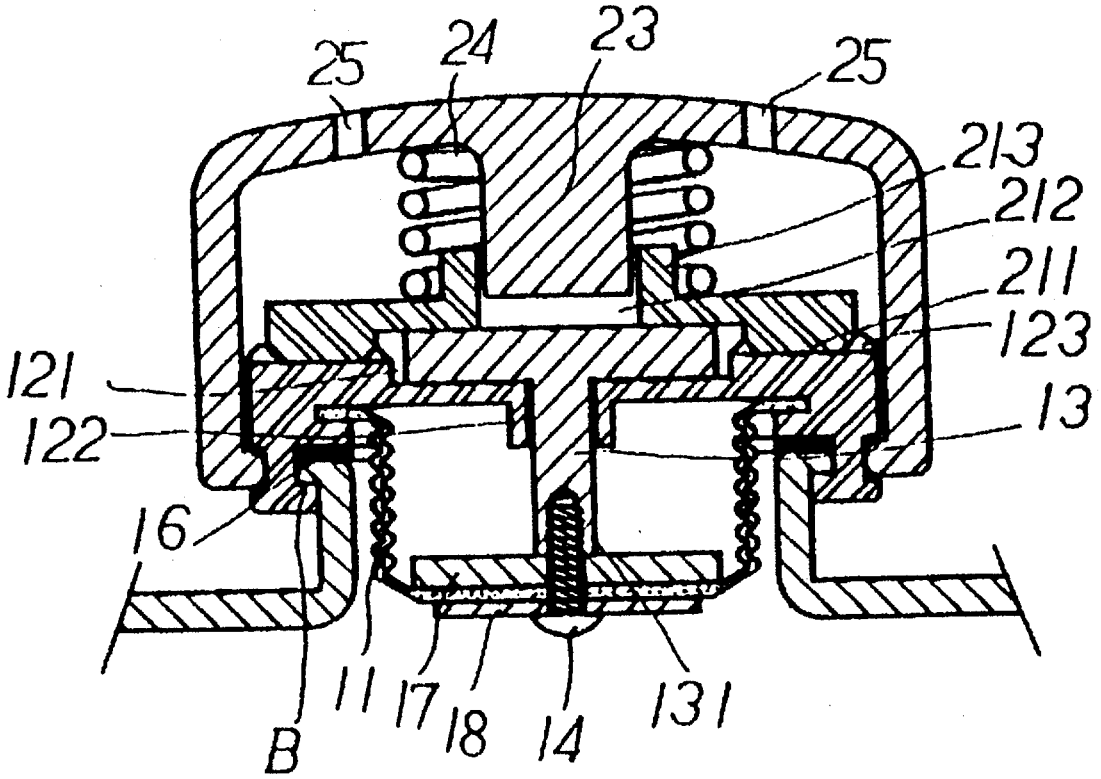
Figure 4:
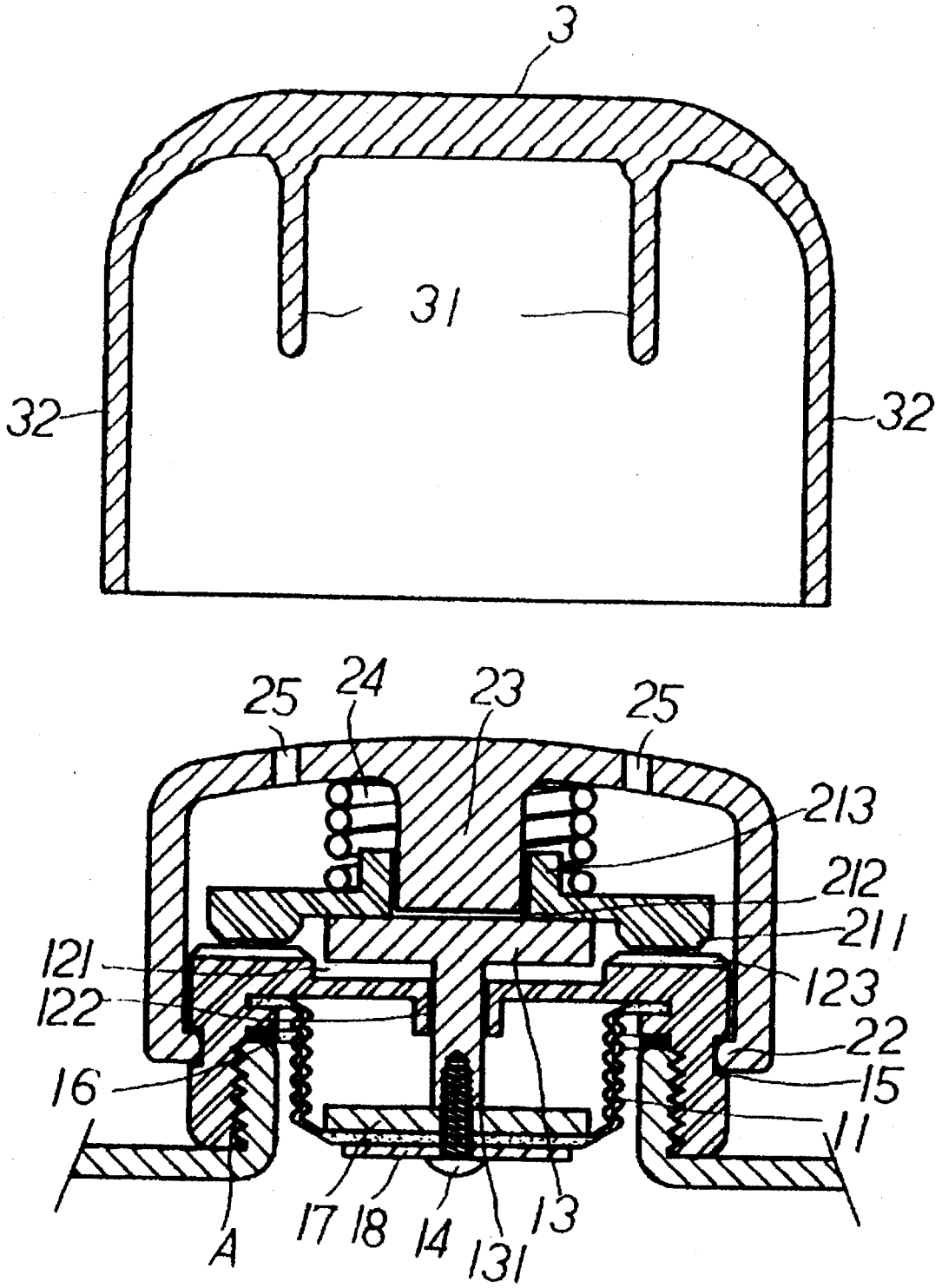
FIG. 4 is a cross-sectional view of a radiator cover with threads on the inner periphery of a toothed disk while an outer cover is separated.
Figure 5:
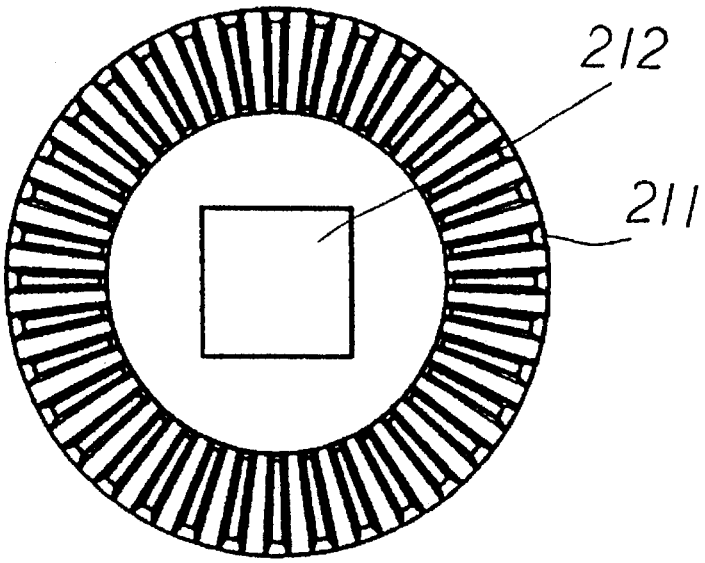
FIG. 5 is a bottom plan view of a toothed plate.
Figure 6:
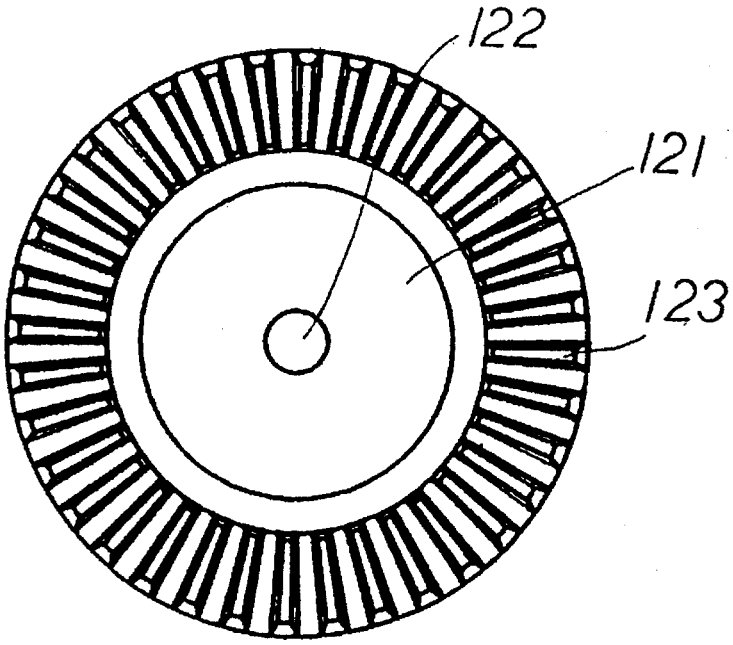
FIG. 6 is a top plan view of a toothed disk.

Referring to FIGS. 1 to 4, a radiator cover has an inner cover 1, a middle cover 2 and an outer cover 3. However, two alternatives can be provided in the inner periphery of the inner cover 1. Referring to FIGS. 2 and 4 again, the inner periphery of a toothed disk 12 of the inner cover 1 has a plurality of threads A to fasten the inner cover 1 on the opening of the first type of radiator tightly. Referring to FIG. 3 again, the inner periphery of a toothed disk 12 of the inner cover 1 has a plurality of inner flanges B which can be rotated to fasten the inner cover 1 on the opening of the second type of radiator tightly. Except the tiny difference of the inner periphery of the inner cover 1, the elements as shown in FIG. 3 is the same as those shown in FIGS. 2 and 4.

The inner cover 1 has a circular plate 13 with an inner threaded post 131 extending downward, a toothed disk 12, a first round gasket 17, a serpentine plug 11, a second round gasket 18, a bolt 14 and a circular washer 16. The toothed disk 12 has an annular groove 15 surrounding the outer periphery of the toothed disk 12, a plurality of teeth 123 surrounding the upper rim of the toothed disk 12, a circular recess 121 defined by the teeth on the top of the toothed disk 12, and a center hole 122 on the top of the toothed disk 12. The circular plate 13 is disposed on the circular recess 121. The inner threaded post 131 passes through the first round gasket 17, the serpentine plug 11 and the second round gasket 18. Then the bolt 14 screws the threads in the inner threaded post 131 tightly. Thus the serpentine plug 11 is beneath the toothed disk 12, and the first and second gaskets 17 and 18 seal the upper and lower openings of the serpentine plug 11, respectively. The circular washer 16 is disposed on the annular groove 15 tightly. Thus the circular washer 16 engages with the water inlet C1 tightly.

The hollow cylindrical middle cover 2 has a bottom inward flange 22, two inserted holes 25 formed on the top surface of the middle cover 2, a square post 23 extending downward from the top portion of the middle cover 2, a compressed spring 24 passed by the square post 23, and a toothed plate 21 with a square hole 212 inserted by the square post 23. The toothed plate 21 has a plurality of serrations 211 at the bottom surface of the toothed plate 21, a cylinder 213 on the top of the toothed plate 21, and a square hole 212 formed at the center of the cylinder 213. The cylinder 213 inserts in the lower portion of the compressed spring 24. The serrations 211 engage, with the teeth 123 so that the middle cover 2 and the inner cover 1 are coupled.

The hollow cylindrical outer cover 3 has a circular wall 32 and two pins 31 extending downward from the top portion of the outer cover 3. The pins 31 insert tightly into the corresponding inserted holes 25, respectively. The wall 32 encloses the outer periphery of the water inlet C1 tightly.

Referring to FIGS. 2, 4, 5 and 6, the assembled radiator cover which contains the middle cover 2 and the inner cover 1 covers the water inlet C1 tightly. When the pressure and temperature of the radiator become very high, the serpentine plug 11 will rise up to withstand the circular plate 13 upward. Thus the toothed plate 21 will be withstood upward also, so the serrations 211 will disengage with the teeth 123. If the user want to open the radiator cover, the radiator cover will be idle-rotated so that it cannot be opened. After the pressure and temperature of the radiator are reduced to the normal pressure and temperature, the serpentine plug 11 will decend so that the serrations 211 will engage with the teeth 123 again.

However, the user has to open the radiator cover in case of emergency. The user can insert two pins 31 of the outer cover 3 into the corresponding inserted holes 25 so that the toothed plate 21 can be pressed downward. The serrations 211 will engage with the teeth 123 again. The water will flow from the water inlet C1 to the interior of the outer cover 3 and then flow downward. The inner pressure of the radiator and the outer pressure will be balanced, so the water will not spout upward. Thus the radiator cover can be opened safely.

The invention is not limited to the above embodiment but various modification thereof may be made. It will be understood by those skilled in the art that various changes in form and detail may be made without departing from the scope of the invention.

I claim:

1. A radiator cover comprising:

an inner cover having a circular plate with an inner threaded post extending downward, a toothed disk, a first round gasket, a serpentine plug, a second round gasket, a bolt and a circular washer;

said toothed disk having an annular groove surrounding an outer periphery of said toothed disk;

a plurality of teeth surrounding an upper rim of said toothed disk;

a circular recess defined by said teeth on top of said toothed disk;

a center hole on top of said toothed disk;

said circular plate disposed on said circular recess;

said inner threaded post passing through said first round gasket, said serpentine plug and said second round gasket;

said bolt screwing a plurality of threads in said inner threaded post tightly;

said serpentine plug beneath said toothed disk;

said first and second gaskets seal an upper and a lower openings of said serpentine plug, respectively;

said circular washer disposed on said annular groove tightly;

a hollow cylindrical middle cover having a bottom inward flange, two inserted holes formed on a top surface of said middle cover, a square post extending downward from a top portion of said middle cover, a compressed spring passed by said square post, and a toothed plate with a square hole inserted by said square post;

said toothed plate having a plurality of serrations at a bottom surface of said toothed plate, a cylinder on top of said toothed plate, and a square hole formed at a center of said cylinder;

said cylinder inserting in a lower portion of said compressed spring;

said serrations engaging with said teeth;

a hollow cylindrical outer cover having a circular wall and two pins extending downward from a top portion of said outer cover;

said pins inserting tightly into said corresponding inserted holes, respectively;

said outer cover covering said middle cover; and said middle cover covering said inner cover.

* * * * *